US006675625B1

(12) United States Patent
Roche et al.

(10) Patent No.: US 6,675,625 B1
(45) Date of Patent: Jan. 13, 2004

(54) METHOD AND ARRANGEMENT FOR CHANGING THE SHAPE OF THIN-SHELL ARTICLES MANUFACTURED BY SPRAY-FORM TECHNIQUES

(75) Inventors: Allen Dennis Roche, Saline, MI (US); Sankaran Subramaniam, Canton, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/065,697

(22) Filed: Nov. 11, 2002

(51) Int. Cl.[7] ..... B21D 37/16

(52) U.S. Cl. ..... 72/342.1; 72/17.3; 72/31.1; 72/342.94

(58) Field of Search ..... 72/342.1, 342.5, 72/342.6, 342.94, 342.96, 17.3, 31.02, 31.03, 31.1, 705

(56) References Cited

U.S. PATENT DOCUMENTS 5,658,506 A * 8/1997 White et al. ..... 264/28
5,719,374 A * 2/1998 Frackiewicz et al. ..... 72/342.5

FOREIGN PATENT DOCUMENTS

JP 62-134118 * 6/1987 ..... 72/342.1
JP 4-224019 * 8/1992 ..... 72/705
JP 5-245543 * 9/1993 ..... 72/342.1
JP 6-541 * 1/1994 ..... 72/342.1

OTHER PUBLICATIONS

"Bending of Titanium Sheet Using Laser Forming", by Daniel F. Walczyk et al, Journal of Manufacturing Processes, vol. 2, No. 4, 2000, pp. 258–269.

Website, http://www.thefabricator.com, "Knowledge, A New Neural Network", 2 pp.

Website, http://www.thefabricator.com, "Knowledge, Predicting the outcomes of laser thermal forming", 3 pp.

Website, http://www.thefabricator.com, "Knowledge, The FLAIR Project", 3 pp.

* cited by examiner

*Primary Examiner*—Ed Tolan
(74) *Attorney, Agent, or Firm*—Brooks Kushman P.C.; Damian Porcari

(57) ABSTRACT

The present invention discloses a method of correcting the shape of a spray-formed article which has a concave bowing relative to the working surface of the article. Specifically, deviations of such articles from a desired predetermined shape are corrected by applying sufficient heat to a non-working surface to permanently remove at least a partial amount of the concave bowing while leaving the working surface substantially unmarred. This process is repeated iteratively until the article achieves the predetermined shape.

23 Claims, 1 Drawing Sheet

METHOD AND ARRANGEMENT FOR CHANGING THE SHAPE OF THIN-SHELL ARTICLES MANUFACTURED BY SPRAY-FORM TECHNIQUES

BACKGROUND OF INVENTION

1. Field of the Invention

In at least one aspect, the present invention relates generally to a method of making spray-formed articles and, more specifically, to a method of changing the shape of such spray-formed articles.

2. Background Art

The rapid production of prototype and production tooling is becoming increasingly important in the automotive industry. Most important is prototype and production tooling used in stamping, die casting and molding. Currently, small sets of prototype tooling can take from six to eight weeks to fabricate, while large prototype tools can take two to three months to produce. Large production dies can take up to a year to fabricate. Furthermore, prototype spray-form tooling has potential to produce production volumes because such prototypes can be made from steel which has sufficient durability and robustness. The spray-form process is capable of producing prototype tooling in less than one month at a cost that is equal or lower than conventional methods.

In the spray-forming process, hot molten steel droplets are sprayed onto a ceramic pattern (i.e., ceramic mold) to form a desired tool. The ceramic pattern is essentially the reverse of the desired tool to be produced. Typically, the ceramic pattern is produced using conventional casting techniques. A ceramic slurry is poured onto a master model and solidified to form the ceramic pattern. When solidification is complete, the resulting ceramic pattern is put through a series of heat cycles and becomes the receptor onto which metal is sprayed to form a deposit in the shape of the desired tool. The spray-forming process requires that such a ceramic pattern be made from a material that has excellent dimensional accuracy and superior surface finish. A suitable ceramic material is aluminum oxide.

One typical spray-forming process comprises wire-arc thermal spraying. In a common type of wire-arc spraying, electric current is carried by two electrically conductive, consumable wires with an electric arc forming between the wire tips. A high-velocity gas jet blowing from behind the consumable wire tips strips away the molten metal, which continuously forms as the wires are melted by the electric arc. The high-velocity gas jet breaks up or atomizes the molten metal into finer particles to create a distribution of molten metal droplets. The atomizing gas then accelerates the droplets away from the wire tips towards the ceramic pattern where the molten metal droplets impact the ceramic pattern to incrementally form a deposit in the shape of the desired article.

The desired article is then removed from the ceramic pattern. The removal is typically accomplished by chiseling off the majority of the ceramic pattern, removing residual ceramic from the surface of the desired article using a glass bead blaster, and then cutting off the perimeter of the metal deposit with a high pressure water jet. In the case of a tool, the completed tool is then mounted and used to produce parts in conventional stamping, die casting, molding, or other tool-usable processes.

Residual stresses are controlled in the spray-formed article by regulation of the metal deposition temperature.

Such temperature control allows for good geometric accuracy. However, occasionally, unavoidable temperature deviations produces a tool that is slightly warped at one or more regions of the tool. Typically, in the spray-forming process, these warped regions are under compressive tension and bow concavely relative to the surface that was in direct contact with the ceramic mold.

Although the above process for making a spray-formed article has worked well, there is still a need to correct the warped regions in the occasionally produced spray-formed tool. Typically, such a deformed part will not be corrected and will instead be discarded. Correction of such deformed articles will reduce costs associated with scrap loses and further improve the throughput of the spray-formed process.

SUMMARY OF INVENTION

The present invention overcomes the problems encountered in the prior art by providing in one embodiment a method of correcting the shape a spray-formed article. The method of present invention comprises:

a) providing a spray-formed article having a working surface and a non-working surface wherein at least one portion of the spray-formed article has a concave bowing relative to the working surface;

b) applying sufficient heat to the non-working surface to permanently remove at least a partial amount of the concave bowing in the article;

c) measuring the deviation from the predetermined shape in the at least one portion of the article; and d) repeating steps b) and c) until the at least one portion has reached a predetermined shape;

wherein the heat applied in step b) does not substantially mar the surface of the working surface. A number of sources may be used to accomplish the tension relief of the present invention. Preferred heat sources are spatially confined heat sources such as lasers, flames produced from torches, and radiant heat sources.

BRIEF DESCRIPTION OF DRAWINGS

The invention will now be described in greater detail in the following way of example only and with reference to the attached drawing, in which.

DETAILED DESCRIPTION

Figure 1:
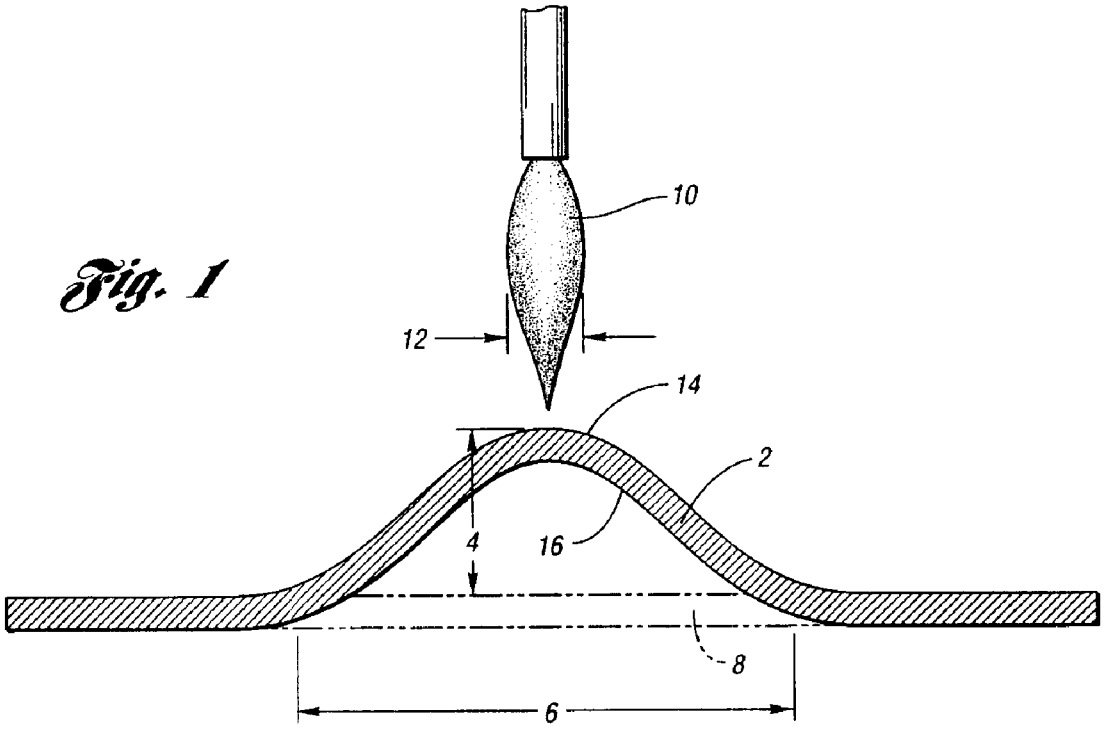
FIG. 1 is a schematic of a heat treating configuration utilizing the method of the present intention.

Reference will now be made in detail to presently preferred compositions or embodiments and methods of the invention, which constitute the best modes of practicing the invention presently known to the inventors.

In an embodiment of the present invention, a method of correcting the shape of an object is provided. The method of this embodiment comprises:

a) providing a spray-formed article having a working surface and a non-working surface wherein at least one portion of the spray-formed article has a concave bowing relative to the working surface;

b) applying sufficient heat to the non-working surface to permanently remove at least a partial amount of the concave bowing in the article;

c) measuring the deviation from the predetermined shape in the at least one portion of the article; and d) repeating steps b) and c) until the at least one portion has reached a predetermined shape;

wherein the heat applied in step b) does not substantially mar the surface of the working surface. The method of the present invention is applied to any metallic spray-formed article. Spray-formed articles are particularly suited to the method of the present invention because such objects are formed as metallic shells with uniform thickness. Typically, the thicknesses of spray-formed articles are typically from about 0.5 inches to about 1 inch. Preferably, the spray-formed article of the present invention is a tool which is used in such processes as stamping, die casting, and molding. Although the present invention is not limited to any particular mechanism that causes the spray-formed article to bow concavely relative the working surface, typically such bowing is the result of the article being in compressive tension after the article cools and is removed from the mold.

A number of sources may be used to remove the concave bowing and thereby correct the shape of the spray-formed. Such heat sources include, but are not limited to, flames, plasma torches, laser beams and radiant heat sources. Preferably, the heat source applied to the non-working surface will be of confined spatial extent. Suitable confined heat sources include, but are not limited to, plasma torches, flames, laser beams and radiant heat sources. Preferred flame sources include oxy-acetylene torches and hydrogen torches. A suitable radiant heat source is the Vortex™ white light heat source.

The deviation from a predetermined shape is determined manually by measuring the dimensions of the spray-formed article and comparing these measured dimensions to a desired model. As used herein, the deviation is the maximum distance that the portion of the spray-formed part deviates from a predetermined shape. More preferably, the deviation is measured by a computer-assisted imaging device such as a shape grabber, which is commercially available from Shape Grabber Inc. For a given heat source, the time necessary to provide the sufficient heat applied to the non-working sufficient is determined by creating a calibration chart from a test sample with know deviation from a test predetermined shape. Such a chart will plot the deviation versus the time for which heat is applied. Alternatively, various computational programs such as the Flair technology available from N.A. Technologies may be used to calculate amount of heat needed to be applied to the non-working surface. Moreover, the heat source is preferably of sufficient intensity to melt a 0.1 mm depth of the spray-formed article in less than 5 seconds.

With reference to FIG. 1, the portion of concavely bowing spray-formed article 2 for which the shape is to be corrected is characterized by deviation 4 and deviation extent 6. As used herein, the term "deviation extent" refers to the maximum length that can be measured in the portion of the spray-formed article that deviates from an desired shape 8. (The dashed lines in FIG. 1 show the desired shape of article 2.) Furthermore, the flame or laser beam are characterized by a spatial extent length. In this context, the spatial extent length is the diameter of an imaginary circle perpendicular to the direction of the flame or laser beam that through which at least 50% of the energy flows. In FIG. 1, flame 10 is characterized by spatial extent 12. Typically, the spatial extent length is less than the deviation extent. The spatial extent length is preferably from 1/10 to ½ the deviation extent and, more preferably, the spatial extent length is from 1/10 to ⅓ the deviation extent. Spray-formed articles are generally in compressive tension when removed from the mold on which they are formed. Accordingly, such articles tend to bow concavely relative to the working surface. The working surface is the surface of the article that comes in direct contact will metal stock or plastic in such forming processes as stamping, die casting and molding. Such surfaces require a high degree of perfection and should not be marred. In FIG. 1, flame 10 is only applied to non-working surface 14 leaving working surface 16 unmarred.

The method of the present invention is typically practiced by moving the heat source along the non-working surface of the at least one portion of the spray-formed article. In a further refinement, the heat source is moved along a pattern formed by a set of essentially parallel lines characterized by a separation distance between each line in the series. The separation distance is preferably less than the deviation extent. Preferably, the separation distance is from about 1/10 to ½ the deviation extent. In a more preferred variation of the present invention, the flame or laser beam is moved along a grid pattern. In this variation, the grid pattern is formed by a first series of essentially parallel lines characterized by a first distance between each line in the first series and a second set of essentially parallel lines characterized by a second distance between each line in the second series. Preferably, the first set of parallel lines are at an angle from about 10 to about 90 degrees relative to the second set of parallel lines and both the first distance and second distance are less than the deviation extent. Most preferably, the first set of parallel lines are at an angle from 90 degrees relative to the second set of parallel lines. Furthermore, the first distance and second distance are preferably from about 1/10 to ½ the deviation extent. The rate at which a heat source is moved along the non-working surface is preferably determined by creating a calibration chart from a test sample with known deviation. Such a calibration chart plots the deviation the speed at which a given heat source is moved along the nonworking surface. Alternatively, various computational programs such as the Flair technology available from N.A. Technologies may be used to calculate amount of heat needed to be applied to the non-working surface.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of correcting the shape of an object, the method comprising:

a) providing a spray-formed article having a working surface and a non-working surface wherein at least one portion of the spray-formed article has a concave bowing relative to the working surface;

b) applying sufficient heat to the non-working surface to permanently remove at least a partial amount of the concave bowing in the article;

c) measuring a deviation from a predetermined shape in the at least one portion of the article; and d) repeating steps b) and c) until the at least one portion has reached a predetermined shape;

wherein the heat applied in step b) does not substantially mar the surface of the working surface.

2. The method of claim 1 wherein a heat source of confined spatial extent is used to supply heat in the steps of applying the sufficient heat to the non-working surface.

3. The method of claim 2 wherein the heat source of confined spatial extent is a flame, laser beam or radiant heat source.

4. The method of claim 2 wherein the at least one portion is characterized by a deviation extent and the heat source is characterized by a spatial extent length such that the spatial extent length is less than the deviation extent.

5. The method of claim 4 wherein the spatial extent length is from 1/10 to ½ the deviation extent.

6. The method of claim 4 wherein the spatial extent length is from 1/10 to ⅓ the deviation extent.

7. The method of claim 4 wherein the heat source is moved along the at least one portion of the spray-formed article.

8. The method of claim 4 wherein the heat source is moved along a pattern formed by a set of essentially parallel lines characterized by a separation distance between each line in the series, the separation distance being less than the deviation extent.

9. The method of claim 8 wherein the first distance and second distance are from about 1/10 to ½ the deviation extent.

10. The method of claim 1 wherein the step of applying the sufficient heat is accomplished by directing a radiant heat source onto the non-working surface.

11. The method of claim 1 wherein the deviation from a predetermined shape is measured by a computer assisted imaging device.

12. The method of claim 1 wherein the sufficient heat applied to the non-working sufficient is determined by creating a calibration chart from a test sample with know deviation from a test predetermined shape.

13. A method of correcting the shape of an object, the method comprising:

a) providing a spray-formed tool having a working surface and a non-working surface wherein at least one portion of the spray-formed tool has a concave bowing relative to the working surface;

b) applying sufficient heat to the non-working surface to permanently remove at least a partial amount of the concave bowing in the tool;

c) measuring a deviation from a predetermined shape in the at least one portion of the tool; and d) repeating steps b) and c) until the at least one portion has reached a predetermined shape;

wherein the heat applied in step b) does not substantially mar the surface of the working surface.

14. The method of claim 13 wherein a heat source of confined spatial extent is used to supply heat in the steps of applying the sufficient heat to the non-working surface.

15. The method of claim 14 wherein the heat source of confined spatial extent is a flame, laser beam, or radiant heat source.

16. The method of claim 14 wherein the at least one portion is characterized by a deviation extent and the heat source is characterized by a spatial extent length such that the spatial extent length is less than the deviation extent.

17. A method of correcting the shape of an object, the method comprising:

a) providing a spray-formed article having a working surface and a non-working surface wherein at least one portion of the spray-formed article has a concave bowing relative to the working surface;

b) applying sufficient heat to the non-working surface to permanently remove at least a partial amount of the concave bowing in the article wherein a heat source of confined spatial extent is used to supply heat and the heat source is moved along a grid pattern, the grid pattern formed by a first series of essentially parallel lines characterized by a first distance between each line in the first series of parallel lines and a second set of essentially parallel lines characterized by a second distance between each line in the second series and the first set of parallel lines are at an angle from about 10 to about 90 degrees relative to the second set of parallel lines;

c) measuring a deviation from a predetermined shape in the at least one portion of the article wherein the at least one portion is characterized by a deviation extent and the heat source is characterized by a spatial extent length such that the spatial extent length is less than the deviation extent and wherein the first distance between each line in the first series of parallel lines and second distance between each line in the second series and the first set of parallel lines are less than the deviation extent; and d) repeating steps b) and c) until the at least one portion has reached the predetermined shape;

wherein the heat applied in step b) does not substantially mar the surface of the working surface.

18. The method of claim 17 wherein the first set of parallel lines are at an angle of 90 degrees relative to the second set of parallel lines.

19. The method of claim 17 wherein the first distance and second distance are from about 1/10 to ½ the deviation extent.

20. The method of claim 17 wherein the spatial extent length is from 1/10 to ⅓ the deviation extent.

21. The method of claim 17 wherein the heat source of confined spatial extent is a flame, laser beam or radiant heat source.

22. The method of claim 17 wherein the heat source of confined lame or laser beam.

23. The method of claim 17 wherein the spray formed article is a spray formed tool.

* * * * *